US005388431A

United States Patent [19]

Izumi

[11] Patent Number: 5,388,431

[45] Date of Patent: Feb. 14, 1995

[54] DUST-REMOVING AND OIL-FEEDING INJECTION NOZZLE APPARATUS IN THE KNITTING UNIT OF A KNITTING MACHINE

[75] Inventor: Toshiro Izumi, Hyogo, Japan

[73] Assignee: Precision Fukuhara Works, Ltd., Hyogo, Japan

[21] Appl. No.: 134,338

[22] Filed: Oct. 12, 1993

[30] Foreign Application Priority Data

Oct. 20, 1992 [JP] Japan ..... 4-307774

[51] Int. Cl.[6] ..... D04B 35/32

[52] U.S. Cl. ..... 66/168; 66/8

[58] Field of Search ..... 66/7, 8, 17, 168; 15/320, 321; 184/55.1, 55.2; 222/148; 417/151

[56] References Cited

U.S. PATENT DOCUMENTS

| | | | |
|---|---|---|---|
| 4,205,708 | 6/1980 | Burgbacher | 66/8 X |
| 4,719,768 | 1/1988 | Lomati | 66/8 |
| 4,741,181 | 3/1988 | Plath | 66/168 X |
| 4,787,404 | 11/1988 | Klosterman et al. | 15/320 X |
| 4,843,843 | 7/1989 | Rovinsky | 66/168 |
| 5,020,636 | 6/1991 | Daeges | 184/55.1 X |
| 5,154,259 | 10/1992 | Magome | 66/8 X |
| 5,197,569 | 3/1993 | Roessler et al. | 184/55.1 |
| 5,226,565 | 7/1993 | Hladis et al. | 222/148 X |
| 5,282,372 | 2/1994 | Gutschmidt | 66/168 |

FOREIGN PATENT DOCUMENTS

| | | | |
|---|---|---|---|
| 0427047 | 5/1991 | European Pat. Off. . | |
| 0549871 | 7/1993 | European Pat. Off. . | |
| 2004770 | 8/1971 | Germany . | |
| 2543913 | 4/1977 | Germany . | |
| 3609440 | 10/1987 | Germany . | |
| 52-33705 | 8/1977 | Japan . | |
| 1160660 | 8/1969 | United Kingdom | 66/168 |
| 1207682 | 10/1970 | United Kingdom . | |
| 2179681 | 3/1987 | United Kingdom . | |
| 1296643 | 3/1987 | U.S.S.R. | 66/8 |

*Primary Examiner*—Clifford D. Crowder
*Assistant Examiner*—John J. Calvert
*Attorney, Agent, or Firm*—Bell, Seltzer, Park & Gibson

[57] ABSTRACT

An injection nozzle for removing dust, lint and waste fibers from and lubricating a knitting unit located on a rotating cylinder of a circular knitting machine. The injection nozzle is located between the sinker cap and the sinker cam in general axial alignment with the sinker groove. The injection nozzle includes a tip opening located adjacent the knitting unit and includes a receiving end located opposite the tip opening. Mist-oil and air is supplied to the injection nozzle. A holder is mounted between the mist-oil supply and the injection nozzle to enable the mist-oil and air to move through the receiving end of the injection nozzle to be discharged at the tip opening of the injection nozzle for removing dust, lint and waste fibers from and lubricating the knitting unit when the knitting unit is located adjacent the injection nozzle by rotation of the rotating cylinder.

17 Claims, 2 Drawing Sheets

DUST-REMOVING AND OIL-FEEDING INJECTION NOZZLE APPARATUS IN THE KNITTING UNIT OF A KNITTING MACHINE

FIELD OF THE INVENTION

The present invention relates to the field of knitting machines, and, more particularly, to an apparatus for removing dust, lint and waste fibers from and lubricating a knitting unit of a circular knitting machine.

BACKGROUND OF INVENTION

Conventional knitting units of circular knitting machines are traditionally associated with more than 100 yarn supply bobbins. Waste fibers are generated by engagement of the yarn with the machine's yarn feeding, guiding and/or knitting components. The waste fiber problem is aggravated by the fact that knitting machines are being operated at increasingly faster speeds. The dust, lint and waste fibers generated-accumulate on the knitting components of the knitting unit, such as the needle and the sinker grooves. This dust, lint and waste fibers occasionally gets knitted into the fabric causing defects in the fabric and in some cases, causing damage to the needles and other components of the knitting unit. This accumulation of dust, lint and waste fibers necessitates frequent over hauls of the knitting units on the machine which is both costly and time consuming.

Various types of air blowing cleaning devices have been provided for blowing away dust, lint and waste fibers before they can accumulate to a point where the dust, lint and waste fibers can cause damage to the knitting machine and/or the fabric. These devices usually include one or more injection tubes or nozzles which have tip openings located adjacent the positions where dust, lint and waste fibers are generated. Several of these air injection nozzles are usually employed on a knitting machine, especially a circular knitting machine. These air injection nozzles blow dust, lint and waste fibers away that gather in certain parts while rotating in the same direction as the rotating cylinder or while rotating in a direction opposite to the rotating cylinder. An example of such an arrangement may be found in Japanese Patent Publication No. SHO 52-33705.

Although it is possible to remove dust, lint and waste fibers over a wide range by injecting air from the tip opening of the injection nozzle and by oscillating the nozzle regularly, as disclosed in U.S. Pat. No. 4,691,536 assigned to Applicant, air does not reach the dust, lint and waste fibers that are generated during the process of forming the yarn into stitches using the knitting needles and sinkers. Dust, lint and waste fibers that are not reached by air go into and accumulate in the sinker grooves, making it more difficult to be blown away. Without lubrication, movement of the working parts of the knitting unit causes increased friction and wear, as well as generating increased dust and damage to the fabric being worked.

SUMMARY OF THE INVENTION

In view of the foregoing background, it is therefore an object of the present invention to provide an apparatus for removing dust, lint and waste fibers from a knitting unit located on a rotating cylinder of a circular knitting machine.

It is another object of the present invention to provide an apparatus that effectively removes dust, lint and waste fibers in a knitting unit of a circular knitting machine and which feeds oil to lubricate components of the knitting unit.

These and other objects, features and advantages of the present invention are provided by an apparatus for removing dust, lint and waste fibers from and lubricating a knitting unit located on a rotating cylinder of a circular knitting machine. The knitting unit has a knitting needle and a sinker cooperating therewith. The sinker has a sinker cam for controlling radial movement of the sinker within a sinker groove along a predetermined axial path. An injection nozzle is provided which is located between the sinker cap and the sinker cam in general axial alignment with the sinker groove. The injection nozzle has a tip opening located adjacent the knitting unit and has a receiving end opposite the tip opening. A supply means is provided for supplying mist-oil and air to the injection nozzle. A holder is mounted intermediate the supply means and the injection nozzle, enabling mist-oil and air from the supply means to move through the receiving end of the injection nozzle to the tip opening of the injection nozzle for removing dust, lint and waste fibers from and lubricating the knitting unit, as the knitting unit moves adjacent the injection nozzle by rotation of the rotating cylinder.

A feature of the present invention is the plurality of injection nozzles located around the knitting machine for removing dust, lint and waste fibers from and lubricating each of the knitting units more than once during one revolution of the rotating cylinder.

An additional feature of the present invention is that the plurality of injection nozzles are located equidistance from each other around the knitting machine.

An advantage of the present invention is obtained by a holder defining a first orifice adapted to receive one of mist-oil and air from the supply means. The holder also defines a second orifice adapted to receive the other of mist-oil and air from the supply means. The holder defines a third orifice adapted to receive the receiving end of the injection nozzle and cooperates with the first orifice and the second orifice to move mist-oil and air from the receiving end of the injection nozzle to the tip opening of the injection nozzle for discharge on to the knitting unit.

The injection nozzle provides a further advantage by having a first nozzle and a second nozzle, such that the second nozzle concentrically surrounds the first nozzle.

Mist-oil is discharged from one of the first nozzle and the second nozzle, and air is discharged from the other of the first nozzle and the second nozzle, thereby providing an additional advantage.

The supply means provides an advantage by including a mist joint for supplying mist-oil to one of the first orifice and the second orifice and by including an air joint for supplying air to the other of the first orifice and the second orifice.

The injection nozzle's ability to discharge just air to remove dust, lint and waste fiber from the knitting unit is another feature of the invention.

An additional feature of the invention is the inclusion of a support ring for supporting the yarn a sufficient distance from the injection nozzle to prevent the yarn from acting as a wall when air is discharged from the injection nozzle.

Another object of the present invention is to provide an apparatus for removing dust, lint and waste fibers from and lubricate a knitting unit located on a rotating cylinder of a circular knitting machine having a knitting needle and a sinker movably driven within a sinker groove by a sinker cam. A first nozzle is provided which has a tip opening located adjacent the knitting unit and a receiving end located opposite the tip opening. A second nozzle is provided which surrounds the first nozzle. The second nozzle also has a tip opening adjacent the knitting unit and a receiving end located opposite the tip opening. The second nozzle is located between the sinker cap and the sinker cam. A nozzle holder cooperates with the sinker cap for holding the first nozzle at the receiving end and for also holding the second nozzle at the receiving end. The holder defines a first orifice, a second orifice and a third orifice. A mist joint is coupled to the first orifice of the holder for supplying mist-oil thereto. An air joint coupled to the second orifice of the holder for supplying air thereto. The third orifice is adapted to receive the receiving end of the first nozzle and the receiving end of the second nozzle and be in fluid communication with the first orifice and the second orifice for supplying mist-oil to one of the first nozzle and the second nozzle and for supplying air to the other of the first nozzle and the second nozzle to lubricate the knitting unit and to remove dust, lint and waste fibers from the knitting unit, as the knitting unit moves on the rotating cylinder relative to the first nozzle and the second nozzle.

BRIEF DESCRIPTION OF DRAWINGS

Some of the objects, features and advantages of the present invention having been stated, others will appear as the description proceeds, when taken in conjunction with the accompanying drawings in which;

FIG. I is a side view partially in cross section and partially in phantom showing the apparatus attached to a knitting unit of a circular knitting machine in accordance with the present invention;

Figure 1:
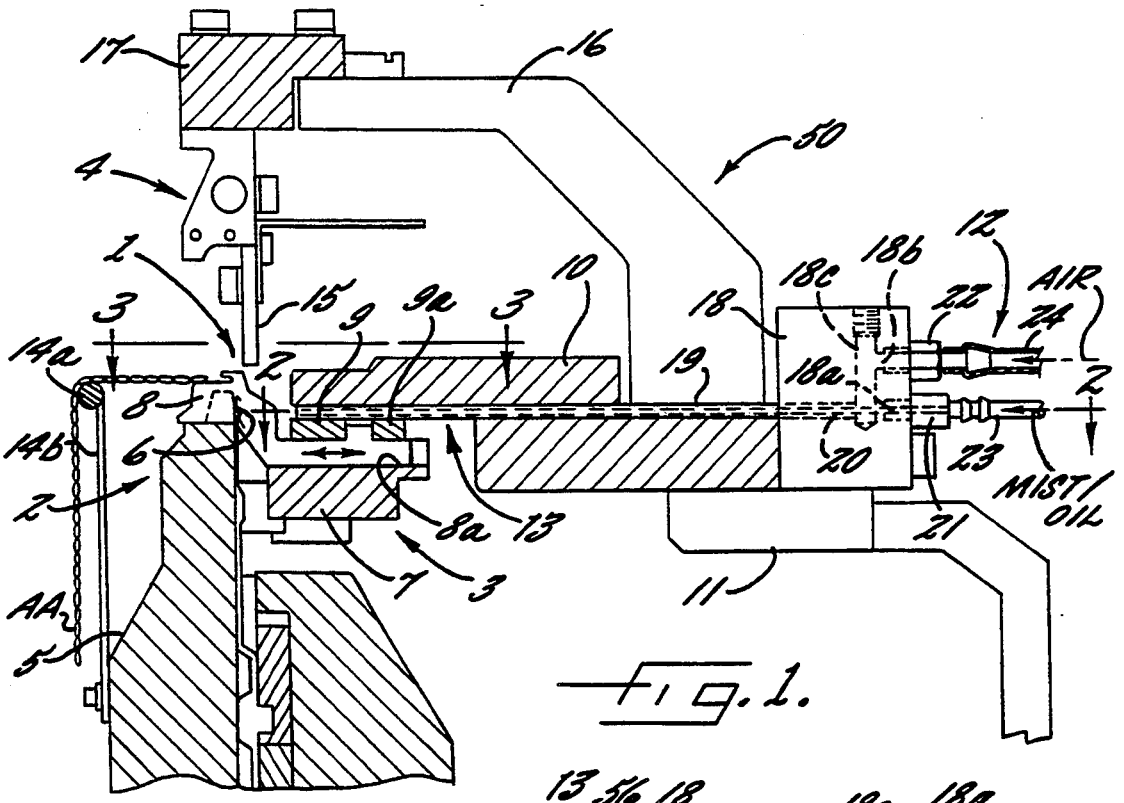
Figure 2:
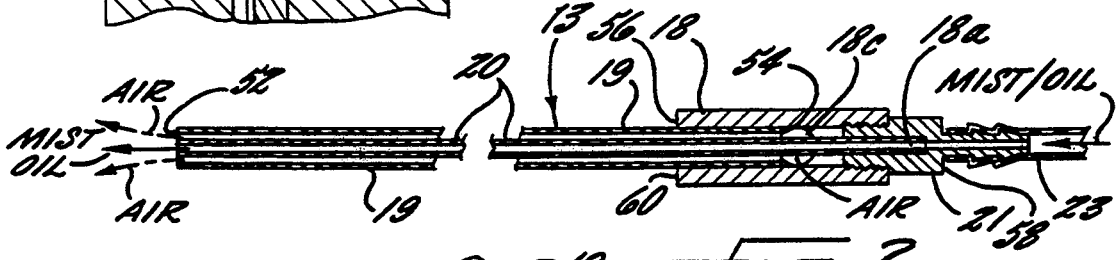
Figure 3:
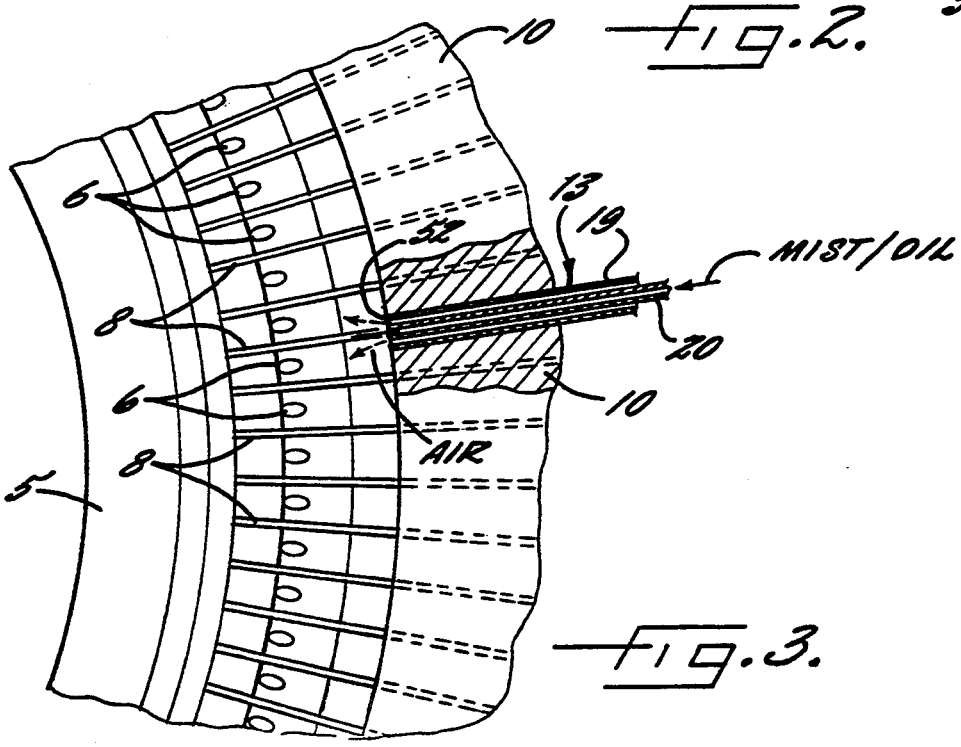
Figure 4:
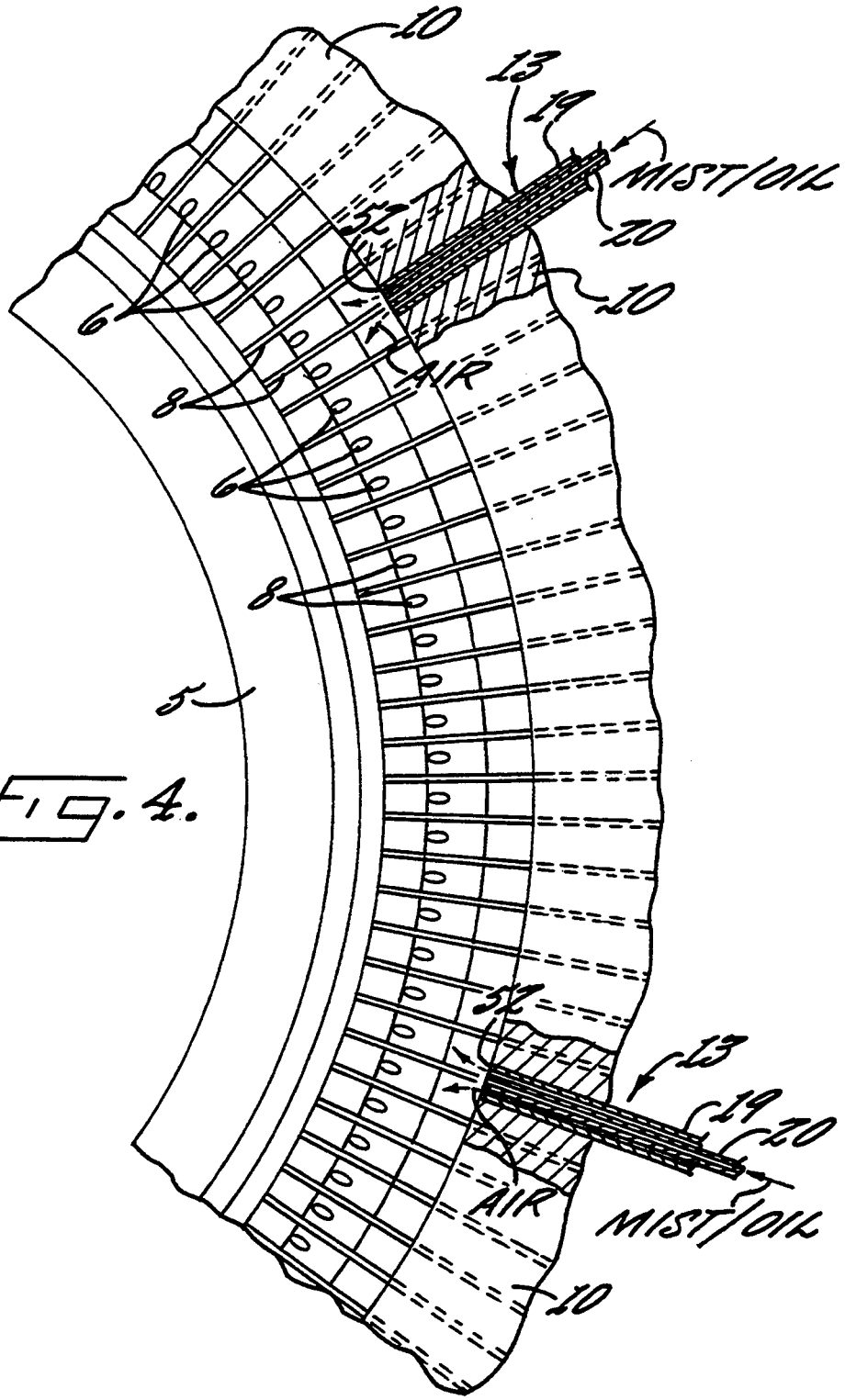

FIG. II is a cross section taken alone Line II—II of FIG. I; and

FIG. III is a plan view taken along Line III—III of FIG. I.

FIG. IV is a view similar to that shown in FIG. III, illustrating an alternative embodiment of the present invention.

DESCRIPTION OF THE ILLUSTRATED EMBODIMENT

The present invention will now be described more fully hereinafter with reference to the accompanying drawings, in which the preferred embodiment of the invention is shown. This invention may, however, be embodied in many different forms and should not be construed as limited to the embodiments set forth herein. Rather, the illustrated embodiment is provided so that this disclosure will be thorough and complete, and will fully convey the scope of the invention to those skilled in the art. Like numbers refer to like elements throughout.

FIGS. I and III of the drawings illustrate a circular knitting machine generally indicated at 50. The circular knitting machine 50 includes a knitting unit generally indicated at 1. The knitting unit 1 includes a needle cylinder section generally indicated at 2, a sinker section generally indicated at 3 and a yarn-carrier section generally indicated at 4. As is well known to those skilled in the art, circular knitting machines of the of the type described in this invention usually include a plurality of knitting units. However, for purposes of the present invention, only one knitting unit will be described, which is representative of all other knitting units on the circular knitting machine of this type.

The needle cylinder section 2 includes a needle 6 to selectively engage yarn to be knitted. The needle 6 reciprocates along a predetermined generally vertical path within a needle groove **6*a* formed around the periphery of a rotating cylinder 5. The rotating cylinder 5 rotates about a vertical axis in response to gearing (not shown) located below the rotating cylinder 5 to rotatingly carry the needle cylinder section 2**.

The sinker section 3 includes a sinker 8 which slides within a sinker groove **8*a* in a radial direction away from the needle 6 along a predetermined generally horizontal path. A sinker 8 of the kind used in the present invention is disclosed in European Patent Nos. 351,935 and 387,094 and U.S. Pat. No. 5,010,744, and incorporated herein by reference. Movement of the sinker 8 is controlled by a sinker cam 9 which is located below a sinker cap 10. The sinker grooves 8*a*, as best seen in FIGS. I and III, are located within a sinker dial 7 and radiate outward from a center point toward the axis of rotation (not shown) of the rotating cylinder 5. The sinker cap 10 is supported by a lower support 11 of the knitting machine 1**, which in turn is held in place by a bed (not shown).

The yarn-carrier section 4 includes a yarn-carrier 15 which feeds yarn to the knitting needle 6. The yarn-carrier 15 is mounted onto a yarn-carrier ring 17 by a yarn-carrier ring support 16 that is positioned above the sinker cap 10. The yarn-carrier 15 contains a support ring 14 which supports fabric indicated at AA. The support ring 14 includes an annular ring **14*a* and a plurality of plates 14*b* that are fastened at one end to the annular ring 14*a* and are mounted at another end to the rotating cylinder 5 by means of conventional fasteners such as bolts. The support ring 14 is adjustable to enable the fabric AA to be supported at a desired distance from the sinker section 3**.

The environment of the present invention having been set forth, an apparatus shown FIGS. I–III and generally indicated at 12, which is the subject of the present invention will now be described in detail. The apparatus 12 has an injection nozzle generally indicated 13 which includes a first nozzle 20 and a second nozzle 19. As best shown in FIGS. II and III the first nozzle 20 and the second nozzle 19 are in concentric relation to each other, such that the second nozzle 19 which has an internal diameter relatively larger than an external diameter of the first nozzle 20, surrounds the first nozzle. The internal diameter of the second nozzle 19 is sufficiently larger than the external diameter of the first nozzle 20 to enable liquid and/or air to flow therethrough.

Each of the first nozzle 20 and the second nozzle 19 has a tip opening 52 at one end and a mounting or receiving end 54 located at an opposite end. The tip opening 52 is located adjacent the knitting unit 1 as the rotating cylinder resolves the knitting unit into the position shown in FIGS. I and III. The receiving end is mounted to a nozzle holder 18 which cooperates with the sinker cap 10 and the lower support 11 to secure or hold the receiving end 54 of both the first nozzle 20 and the second nozzle 19.

The first nozzle 20 and the second nozzle 19 are oriented generally horizontally such that the first nozzle and the second nozzle are seated in a cutout section **9*a* between the sinker cap 10 and the sinker cam 9. The first nozzle and the second nozzle are oriented such that they are in general horizontal alignment with the movement of the sinker 8 within the sinker groove 8***a*, when the rotating cylinder is in the position shown in FIGS. I and III. It is to be understood that the rotating cylinder 5 revolves around its axis (not shown) at a high revolution causing the knitting unit 1 to pass by the stationary injection nozzle 13 once per revolution and several times per minute. Accordingly, the positions shown in FIGS. I and III are merely representative of a frozen moment in time of otherwise continuous movement.

The holder 18 has a generally rectangular configuration with an opposed first end 56 and second end 58. The holder is defines a first orifice 18*a*, a second orifice 18*b* and a third orifice 18*c*. An aperture 6O is located in the first end 56 and extends through the holder along a generally horizontal path to the third orifice 18*c*. The first orifice 18*a* is located below the second orifice 18*b*. The first orifice 18*a* is defined within the second end 58 and projects into the holder 18 into fluid communication with the third orifice 18*c* and is in axial alignment with the aperture 60.

The second orifice 18*b* is located above the first orifice 18*a* and in general parallel alignment therewith. The second orifice 18*b* is defined within the second end 58 and projects into the holder 18 into fluid communication with the third orifice 18*c*.

The third orifice 18*c* is located entirely within the holder 18 and is oriented generally transverse to the first orifice 18*a*, the second orifice 18*b* and the aperture 60. The third orifice 18*c* is in fluid communication with the first and second orifice 18*a* and 18*b* and the aperture 60. The receiving end 54 of the first nozzle 20 and the second nozzle 19 is received within the aperture 60 and secured or held within the holder in fluid communication with the third orifice 18*c*.

A mist joint 21 is threadably connected to the first orifice 18*a* at the second end 58 of the holder 18. An air joint 22 is threadably connected to the second orifice 18*b* at the second end of the holder 18. It is to be understood by those skilled in the art that the mist joint 21 and the air joint 22 may be connected to the first and second orifice 18*a* and 18*b*, respectively by other means such as quick-release couplings, etc. A pair of vinyl tubes 23 and 24 respectively, supply mist-oil and air to the mist joint 21 and the air joint 22. Vinyl tube 23 is attached to the mist joint 21 at one end by a quick coupling 23*a* and is attached at another end to a lubricator (not shown) on the knitting machine. The vinyl tube 24 is attached to the air joint 22 one end by a quick coupling 24*a* and attached at another end to an air source (not shown) on the knitting machine.

In operation, mist-oil is supplied through the mist joint 21 to the first orifice 18*a* from the lubricator and air is supplied through the air joint 22 to the second orifice 18*b* from the air source. The mist-oil and air flow into the third orifice 18*c*. Air then flows into the receiving end 54 of the second nozzle 19 and mist-oil flows into the receiving end 54 of the first nozzle 20. As the rotating cylinder 5 carries the knitting unit i in a generally horizontal path, first toward then by the first nozzle 20 and the second nozzle 19, mist-oil which is continuously discharged from the tip opening 52 of the first nozzle 20 lubricates the sinker groove 8*a* and other components of the knitting unit 1. Simultaneously, air which is also continuously discharged from the tip opening 52 of the second nozzle 19 blows dust, lint and waste fibers from the needle 6, the sinker 8 and the sinker groove 8*a* as well increases the velocity of the mist-oil being discharged by the first nozzle 20. To assist in this process, the support ring 14 supports the fabric AA a sufficient distance from the sinker 8 so that air discharged from the second nozzle 19 does not get forced into the yarn which would then act as a wall preventing effective removal of dust, lint and waste fibers from the knitting unit 1.

The injection nozzle 13 discharges both air and mist-oil in a steady stream is response to the revolution rate of the rotating cylinder 5 and the close proximity of the knitting units to each other.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for removing dust, lint and waste fibers from and lubricating a knitting unit located on a rotating cylinder of a circular knitting machine, the knitting unit having knitting needles and sinkers cooperating therewith, the sinkers having at least one sinker cam for controlling radial movement of the sinkers within sinker grooves along a predetermined axial path and the sinkers having a sinker cap, said apparatus comprising:

an injection nozzle located between the sinker cap and the at least one sinker cam in general radial alignment with an axis of the knitting unit, said injection nozzle having a tip opening located adjacent the knitting unit and said injection nozzle having a receiving end located opposite said tip opening;

supply means for supplying mist-oil and air to said injection nozzle; said injection nozzle situated with respect to the knitting unit so as to apply the mist-oil and air in a generally horizontal direction toward the sinkers and needles; and a holder mounted intermediate said supply means and said injection nozzle, enabling mist-oil and air from said supply means to move through said receiving end of said injection nozzle to be discharged at said tip opening of said injection nozzle for removing dust, lint and waste fibers from and lubricating the knitting unit, when the knitting unit is located adjacent said injection nozzle by rotation of the rotating cylinder.

2. An apparatus according to claim 1 further comprising a plurality of injection nozzles located around the knitting machine for removing dust, lint and waste fibers from and lubricating each of said knitting units more than once per revolution of said rotating cylinder.

3. An apparatus according to claim 2 wherein said plurality of injection nozzles are located equidistance from each other around the knitting machine.

4. An apparatus according to claim 1 wherein said holder defines a first orifice for receiving one of mist-oil and air from said supply means, said holder defining a second orifice for receiving the other of mist-oil and air from said supply means, and said holder defining a third orifice for receiving said receiving end of said injection nozzle and cooperate with said first orifice and said second orifice to move mist-oil and air from said receiving end of said injection nozzle to said tip opening of said injection nozzle, for discharge onto the knitting unit.

5. An apparatus according to claim 4 wherein said injection nozzle further comprises a first nozzle and a second nozzle.

6. An apparatus according to claim 5 wherein said second nozzle and said first nozzle are in concentric relation to each other.

7. An apparatus according to claim 5 wherein mist-oil is discharged from one of said first nozzle and said second nozzle, and air is discharged from the other of said one of said first nozzle and said second nozzle.

8. An apparatus according to claim 4 wherein said supply means comprises a mist joint for supplying mist-oil to one of said first orifice and said second orifice and an air joint for supplying air to the other of said one of said first orifice and said second orifice.

9. An apparatus according to claim 1 wherein said injection nozzle is fixedly mounted to the knitting machine and the rotating cylinder carrying the knitting unit moves relative thereto.

10. An apparatus according to claim 1 wherein air discharged from said injection nozzle increases the velocity of mist-oil discharged.

11. An apparatus for removing dust, lint and waste fibers from and lubricating a knitting unit located on a rotating cylinder of a circular knitting machine, the knitting unit having a knitting needle and a sinker cooperating therewith, the sinker having a sinker cam for controlling radial movement of the sinker within a sinker groove along a predetermined axial path and the sinker having a sinker cap, said apparatus comprising:

a plurality of injection nozzles located between the sinker cap and the sinker cam in general axial alignment with the sinker groove and located equidistance from each other around the knitting machine, each injection nozzle having a tip opening located adjacent the knitting unit and a receiving end located opposite said tip opening, and each injection nozzle having a first nozzle and a second nozzle in concentric relation to each other wherein mist-oil is discharged from one of said first nozzle and said second nozzle, and air is discharged from the other of said one of said first nozzle and said second nozzle;

supply means for supplying mist-oil and air to said injection nozzle;

a holder mounted intermediate said supply means and said injection nozzle, enabling mist-oil and air from said supply means to move through said receiving end of said injection nozzle to be discharged at said tip opening of said injection nozzle for removing dust, lint and waste fibers from and lubricating the knitting unit more than once per revolution of said rotating cylinder, when the knitting unit is located adjacent said injection nozzle by rotation of the rotating cylinder, and said holder defining a first orifice for receiving one of mist-oil and air from said supply means, said holder defining a second orifice for receiving the other of mist-oil and air from said supply means, and said holder defining a third orifice for receiving said receiving end of said injection nozzle and cooperate with said first orifice and said second orifice to move mist-oil and air from said receiving end of said injection nozzle to said tip opening of said injection nozzle, for discharge onto the knitting unit; and a support ring for supporting fabric a sufficient distance from said injection nozzle to prevent the fabric from acting as a wall when air is discharged from said injection nozzle.

12. An apparatus for removing dust, lint and waste fibers from and lubricating a knitting unit located on a rotating cylinder of a circular knitting machine having a knitting needle and a sinker movably driven within a sinker groove by a sinker cam and having a sinker cap, said apparatus comprising:

a first nozzle having a tip opening located adjacent the knitting unit and a receiving end located opposite said tip opening;

a second nozzle surrounding said first nozzle, said second nozzle having a tip opening adjacent the knitting unit and a receiving end located opposite said tip opening, said second nozzle located between the sinker cap and the sinker cam in general axial alignment with the sinker groove;

a nozzle holder cooperating with the sinker cap for holding said first nozzle at said receiving end and for holding said second nozzle at said receiving end, said holder defining a first orifice, a second orifice and a third orifice;

a mist joint coupled to said first orifice of said holder for supplying mist oil thereto;

an air joint coupled to said second orifice of said holder for supplying air thereto;

a support ring for supporting fabric a sufficient distance from said first nozzle and said second nozzle to prevent the fabric from acting as a wall when air is discharged from one of said first nozzle and said second nozzle; and said third orifice receiving said receiving end of said first nozzle and said receiving end of said second nozzle, and said third orifice in fluid communication with said first orifice and said second orifice for supplying mist-oil to one of said first nozzle and said second nozzle and for supplying air to the other of said first nozzle and said second nozzle to lubricate the knitting unit and to remove dust, lint and waste fibers from the knitting unit, as the knitting unit moves on the rotating cylinder relative to said first nozzle and said second nozzle.

13. An apparatus for removing dust, lint and waste fibers from and lubricating a knitting unit located on a rotating cylinder of a circular knitting machine having knitting needles and sinkers each movably driven within a sinker groove by at least one sinker cam and having a sinker cap, said apparatus comprising:

a first nozzle having a tip opening located adjacent the knitting unit and a receiving end located opposite said tip opening;

a second nozzle surrounding said first nozzle, said second nozzle having a tip opening adjacent the knitting unit and a receiving end located opposite said tip opening, said second nozzle located between the at least one sinker cap and the sinker cam;

a nozzle holder cooperating with the sinker cap for holding said first nozzle at said receiving end and for holding said second nozzle at said receiving end, said holder defining a first orifice, a second orifice and a third orifice;

a mist joint coupled to said first orifice of said holder for supplying mist oil thereto;

an air joint coupled to said second orifice of said holder for supplying air thereto; and said third orifice receiving said receiving end of said first nozzle and said receiving end of said second nozzle, and said third orifice in fluid communication with said first orifice and said second orifice for supplying mist-oil to one of said first nozzle and said second nozzle and for supplying air to the other of said first nozzle and said second nozzle to lubricate the knitting unit and to remove dust, lint and waste fibers from the knitting unit, as the knitting unit moves on the rotating cylinder relative to said first nozzle and said second nozzle, the nozzles situated with respect to the knitting unit so as to apply the mist-oil and air in a generally horizontal direction toward the sinkers and needles

14. An apparatus according to claim 13 wherein said first nozzle and said second nozzle are oriented in generally axial alignment with the sinker groove.

15. An apparatus according to claim 13 further comprising a plurality of injection nozzles spaced equidistant from each other on the knitting machine to remove dust, lint and waste fibers and to lubricate each knitting unit at at least once per revolution of the rotating cylinder.

16. An apparatus according to claim 13 wherein said first nozzle and said second nozzle are in concentric relation to each other.

17. An apparatus according to claim 13 wherein air discharged from one of said first nozzle and said second nozzle increases the velocity of mist-oil discharged from the other of said one of said first nozzle and said second nozzle.

* * * * *

UNITED STATES PATENT AND TRADEMARK OFFICE

CERTIFICATE OF CORRECTION

PATENT NO. : 5,388,431

DATED : February 14, 1995

INVENTOR(S) : Izumi

It is certified that error appears in the above-identified patent and that said Letters Patent is hereby corrected as shown below:

Title page, item [56]

"Lomati" should be --Lonati--.

"3/1988 Plath" should be --5/1988 Plath--.

Column 1, line 14, "100" should be --100--.

Column 1, line 20 and 21, "generated-accumulated" should be --generated accumulated--.

Column 1, line 27, "over hauls" should be --overhauls--.

Column 5, line 15, "is" should be --18--.

Signed and Sealed this

Twenty-fifth Day of July, 1995

*Attest:*

Bruce Lehman

BRUCE LEHMAN

*Attesting Officer*

*Commissioner of Patents and Trademarks*